US011158466B2

(12) United States Patent
Otani et al.

(10) Patent No.: US 11,158,466 B2
(45) Date of Patent: Oct. 26, 2021

(54) SWITCH

(71) Applicant: Mitsubishi Electric Corporation, Tokyo (JP)

(72) Inventors: Kohei Otani, Tokyo (JP); Naoaki Inoue, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/977,886

(22) PCT Filed: Nov. 27, 2018

(86) PCT No.: PCT/JP2018/043514
§ 371 (c)(1),
(2) Date: Sep. 3, 2020

(87) PCT Pub. No.: WO2019/215946
PCT Pub. Date: Nov. 14, 2019

(65) Prior Publication Data

US 2020/0395177 A1 Dec. 17, 2020

(30) Foreign Application Priority Data

May 10, 2018 (WO) ..... PCT/JP2018/018119

(51) Int. Cl.
*H01H 1/42* (2006.01)
*H01H 3/32* (2006.01)
(Continued)

(52) U.S. Cl.
CPC ..... *H01H 1/42* (2013.01); *H01H 3/32* (2013.01); *H01H 31/026* (2013.01);
(Continued)

(58) Field of Classification Search
CPC .. H01H 1/42; H01H 1/48; H01H 1/50; H01H 3/32; H01H 31/026; H01H 31/16; H01H 31/28; H01H 2001/425; H01R 13/15
(Continued)

(56) References Cited

U.S. PATENT DOCUMENTS 5,013,876 A * 5/1991 Chabala ..... H01H 1/42 200/254
6,271,489 B1 * 8/2001 Engel ..... H01H 1/42 200/255
(Continued)

FOREIGN PATENT DOCUMENTS

EP 1026710 A2 8/2000
JP S4937167 A 4/1974
(Continued)

OTHER PUBLICATIONS

International Search Report (PCT/ISA/210), with translation, and Written Opinion (PCT/ISA/237) dated Feb. 5, 2019, by the Japan Patent Office as the International Searching Authority for International Application No. PCT/JP2018/043514.

*Primary Examiner* — William A Bolton
(74) *Attorney, Agent, or Firm* — Buchanan Ingersoll & Rooney PC

(57) ABSTRACT

In a switch in which one end portion of a blade is pivotally attached to a fixed contactor and another end portion of the blade is brought into pressure contact with a fixed contactor by rotational operation of the blade, at least one slit is provided in each of a conductive contact surface, with respect to the fixed contactor, of the one end portion of the blade and a conductive contact surface, with respect to the fixed contactor, of the other end portion of the blade, so as to divide each of the conductive contact surfaces, thereby achieving multi-point contact on each of the conductive contact surfaces, and a thickness of a contact-pressure spring
(Continued)

fixing portion of the blade at which a contact-pressure spring for bringing the other end portion into pressure contact with the fixed contactor is made smaller than that of the other end portion.

12 Claims, 6 Drawing Sheets

(51) Int. Cl.
*H01H 31/28* (2006.01)
*H01H 31/02* (2006.01)

(52) U.S. Cl.
CPC ..... *H01H 31/28* (2013.01); *H01H 2001/425* (2013.01); *H01H 2235/01* (2013.01)

(58) Field of Classification Search
USPC ..... 200/254, 243, 244, 245, 246, 255, 256
See application file for complete search history.

(56) References Cited

U.S. PATENT DOCUMENTS

| | | | | |
|---|---|---|---|---|
| 7,777,601 | B2 * | 8/2010 | Kakisako | H01H 73/04 335/196 |
| 8,263,890 | B2 * | 9/2012 | Fujita | H01H 31/023 200/554 |
| 8,969,748 | B2 * | 3/2015 | Endre | H01H 1/42 200/254 |
| 9,734,958 | B2 * | 8/2017 | Huβmann | H01H 1/42 |
| 2006/0175182 | A1 | 8/2006 | Arcand et al. | |
| 2018/0122590 | A1 | 5/2018 | Sano et al. | |

FOREIGN PATENT DOCUMENTS

| | | | |
|---|---|---|---|
| JP | S58314 | U | 1/1983 |
| JP | H03257722 | A | 11/1991 |
| JP | 2004178956 | A | 6/2004 |
| JP | 2004335337 | A | 11/2004 |
| JP | 2006222081 | A | 8/2006 |
| JP | 2010225374 | A | 10/2010 |
| WO | 2015190500 | A1 | 12/2015 |

* cited by examiner

SWITCH

TECHNICAL FIELD

The present disclosure relates to a switch.

BACKGROUND ART

As a disconnector and a grounding switch mounted to a gas-insulated switchgear, a disconnector and a grounding switch in which a blade is used have been known (for example, Patent Document 1 and Patent Document 2). For example, FIG. 4 of Patent Document 1 discloses a structure that includes two pairs of fixed contactors, a blade (movable contactor) including a pair of opposing parallel contactors each provided with a rotation center on one fixed contactor, two pairs of contact-pressure springs, a link, and a pin, and in which the blade becomes mechanically and electrically connected to the fixed contactors on the rotation center side, the power receiving side, the power feeding side, and the grounding side to be energized or grounded, by applying a contact-pressure spring load to the blade.

Moreover, Patent Document 3 indicates that a contact surface is increased by dividing a blade or forming a slit in an end portion of the blade, thereby reducing a current per contact surface to improve reliability.

CITATION LIST

Patent Document

Patent Document 1: Japanese Laid-Open Patent Publication No. 03-257722 (FIG. 3, FIG. 4)

Patent Document 2: Japanese Laid-Open Patent Publication No. 2010-225374

Patent Document 3: Japanese Laid-Open Patent Publication No. 49-37167

SUMMARY OF THE INVENTION

Problems to be Solved by the Invention

As described above, each of the circuits of a disconnector and a grounding switch mounted to a gas-insulated switchgear includes fixed contactors, a blade, contact-pressure springs, a link, and a pin which are made of metal. In the case of a closed circuit, as a large current flows, electromagnetic force is generated, which may open the contact part between the blade and the fixed contactor, causing arcing from the gap between the contactors and welding of the contactors. Thus, it is necessary to apply contact pressure between the contactors by a contact-pressure spring load that is larger than the electromagnetic force.

Therefore, in assembly of the circuit, it is necessary to assemble the circuit while compressing the contact-pressure springs, and a special assembly jig is required to assemble the blade and the fixed contactors, so that the number of steps is increased compared to the manual assembly. In addition, since the contact-pressure load between the contactors is high, when the circuit is repeatedly opened and closed, mechanical wear due to sliding between the contactors occurs on each conductive contact surface, increasing contact resistance and sliding load, whereby a problem in repeated opening and closing and the operation of the switch arises and the reliability decreases. Another problem is that, since the contact-pressure load between the contactors is high, the load on an operation device due to repeated opening and closing of the circuit is high.

The present disclosure discloses a technology for solving the above-described problems, and an object of the present disclosure is to provide a switch that appropriately reduces a contact-pressure load on each of conductive contact surfaces at both one end portion and another end portion of a blade to be rotationally operated, in a well-balanced manner, and that can open and close smoothly.

Solution to the Problems

A switch according to the present disclosure includes: a first fixed contactor; a second fixed contactor disposed at a predetermined interval from the first fixed contactor; and a blade having one end portion which is pivotally attached to the first fixed contactor, and another end portion which is joined to the second fixed contactor by rotational operation by an operation device to bridge and electrically connect the first and second fixed contactors, wherein the one end portion of the blade is brought into pressure contact with the first fixed contactor, the other end portion of the blade is brought into pressure contact with the second fixed contactor by a first contact-pressure spring in a state where the other end portion is joined to the second fixed contactor, at least one slit is provided in each of a conductive contact surface, with respect to the first fixed contactor, of the one end portion of the blade and a conductive contact surface, with respect to the second fixed contactor, of the other end portion of the blade, or in each of a conductive contact surface, with respect to the one end portion of the blade, of the first fixed contactor and a conductive contact surface, with respect to the other end portion of the blade, of the second fixed contactor, so as to divide each of the conductive contact surfaces, and a thickness of a contact-pressure spring fixing portion of the blade at which the first contact-pressure spring is provided is smaller than that of the other end portion of the blade which is joined to the second fixed contactor, a second contact-pressure spring is provided at the one end portion of the blade, and a thickness of the one end portion of the blade is smaller than that of the other end portion of the blade.

Effect of the Invention

In the switch according to the present disclosure, due to achievement of multi-point contact on each of the conductive contact surfaces of the one end portion and the other end portion of the blade by the slits, and due to deformation of the contact-pressure spring fixing portion, opening/closing operation of the switch can be performed smoothly, and a contact-pressure load on each of the conductive contact surfaces at both the one end portion and the other end portion of the blade to be rotationally operated is reduced appropriately in a well-balanced manner, so that the reliability of the switch can be improved and the life of the switch can be extended.

BRIEF DESCRIPTION OF THE DRAWINGS

FIG. 1A shows a side view, FIG. 1B shows a front view, and FIG. 1C is a detailed structural diagram showing a mounted state of a contact-pressure spring.

FIG. 2A shows a side view, and FIG. 2B shows a front view. FIG. 2C is a detailed structural diagram showing a mounted state of a contact-pressure spring.

FIG. 3A shows a plan view, and FIG. 3B shows an end view.

FIG. 5A is a structural diagram showing the configuration of a switch in a closed circuit state, FIG. 5B is a plan view showing the configuration of a fixed contactor, FIG. 5C is a plan view of the fixed contactor and FIG. 5D is an end view of the fixed contactor 11*b*.

FIG. 6A is a front view of the switch, and FIG. 6B is a structural diagram showing an internal configuration in which a connection adapter is removed.

FIG. 7A is a front view of the switch, and FIG. 7B is a structural diagram showing an internal configuration in which a connection adapter is removed.

DESCRIPTION OF EMBODIMENTS

Embodiment 1

Figure 1A:
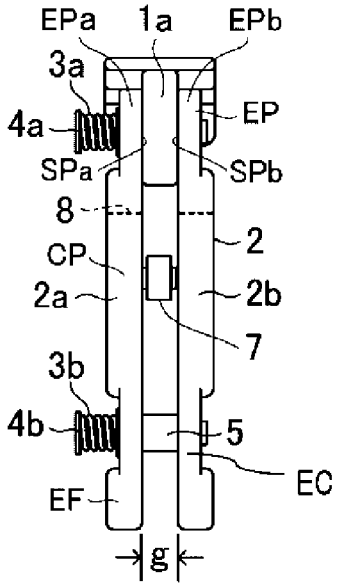
FIGS. 1A to 1C are structural diagrams showing the configuration of a switch according to Embodiment 1 and shows an open circuit state.
Figure 1B:
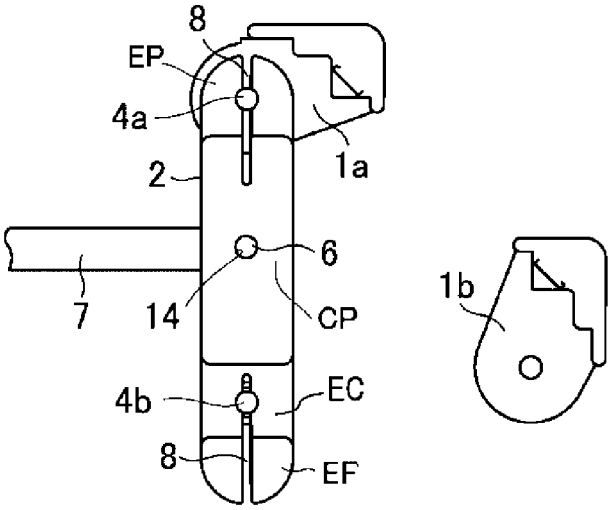
Figure 1C:
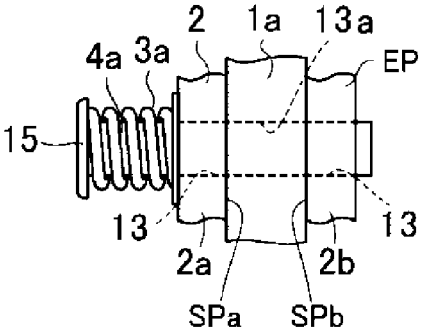
Figure 2A:
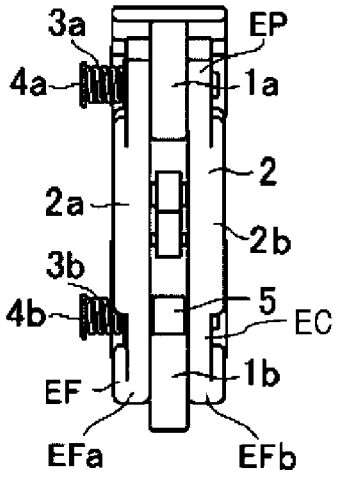
FIGS. 2A to 2C are structural diagrams showing the configuration of the switch according to Embodiment 1 and shows a closed circuit state.
Figure 2B:
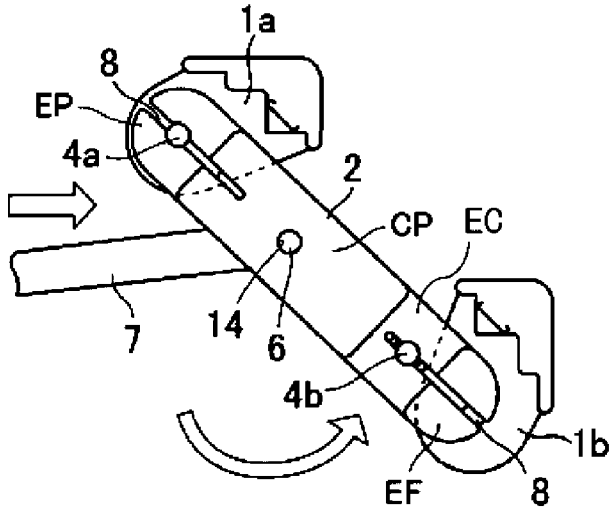
Figure 2C:
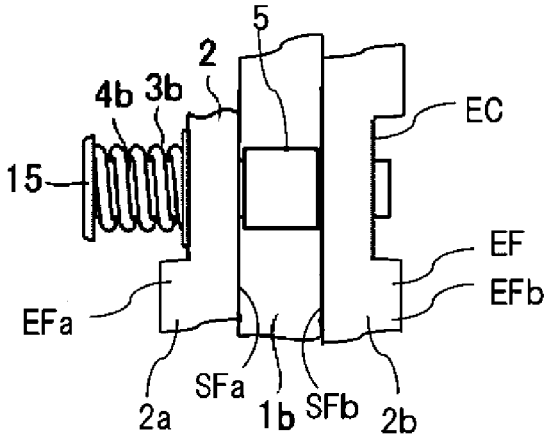
Figure 3A:
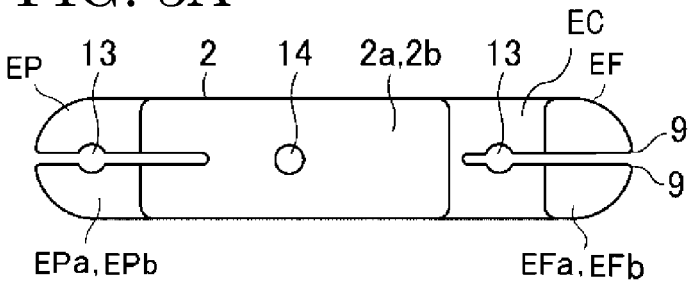
FIGS. 3A and 3B are structural diagrams showing the configuration of a blade of the switch according to Embodiment 1.
Figure 3B:
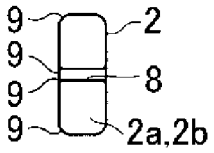
Figure 4:
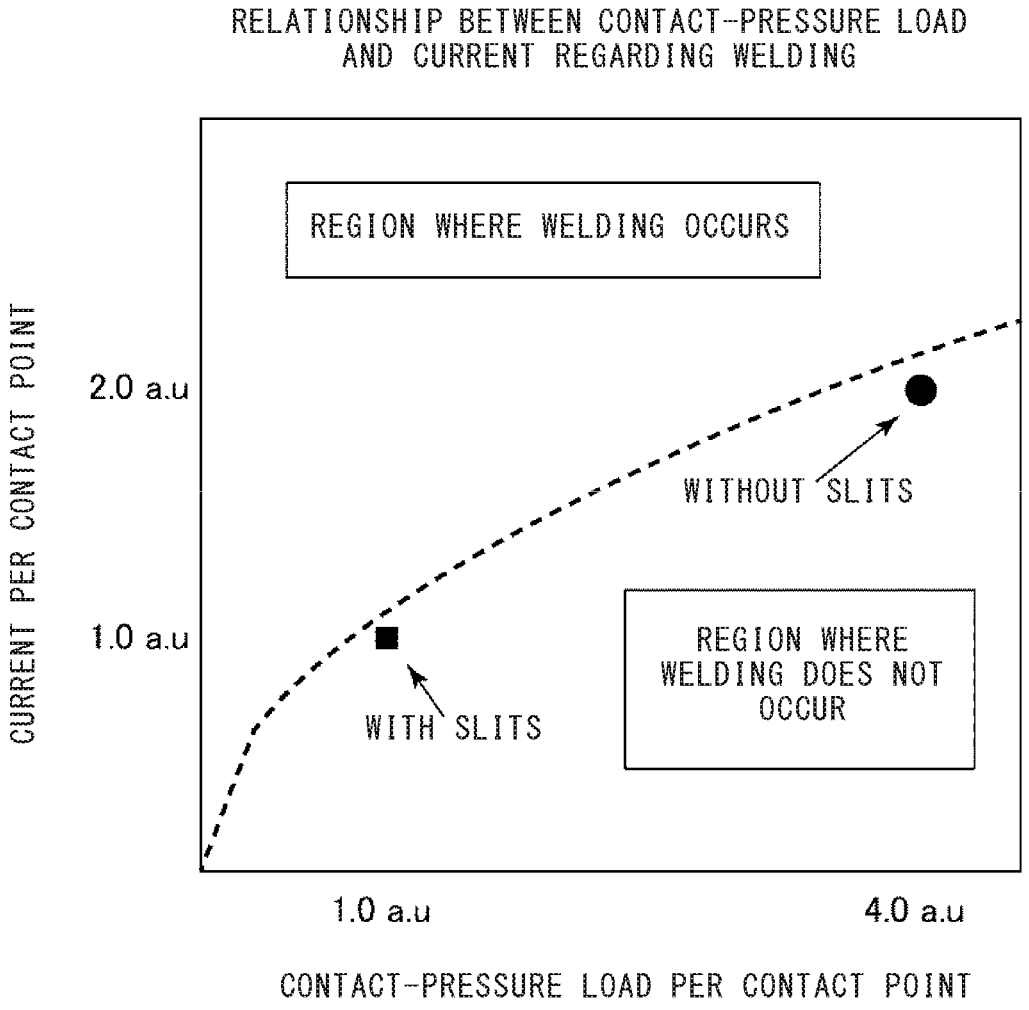
FIG. 4 is a chart showing a relationship between contact-pressure load and current regarding welding of contactors.
Figure 8:
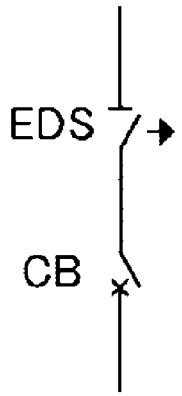
FIG. 8 is a partial circuit diagram showing the connection relation of a switching device mounted to a gas-insulated switchgear.

Embodiment 1 will be described with reference to FIGS. 1A to 1C, FIGS. 2A to 2C, FIGS. 3A and 3B, FIG. 4 and FIG. 8. FIGS. 1A to 1C are structural diagrams showing the configuration of a switch according to Embodiment 1 in an open circuit state, FIG. 1A shows a side view, FIG. 1B shows a front view, and FIG. 1C is a detailed structural diagram showing a mounted state of a contact-pressure spring. FIGS. 2A to 2C are structural diagrams showing the configuration of the switch according to Embodiment 1 in a closed circuit state, FIG. 2A shows a side view, and FIG. 2B shows a front view. FIG. 2C is a detailed structural diagram showing a mounted state of a contact-pressure spring. FIGS. 3A and 3B are structural diagrams showing the configuration of a blade of the switch according to Embodiment 1, FIG. 3A shows a plan view, and FIG. 3B shows an end view. FIG. 4 is a chart showing a relationship between contact-pressure load and current regarding welding of contactors. FIG. 8 is a partial circuit diagram showing the connection relation of a switching device mounted to a gas-insulated switchgear.

The switching device mounted to the gas-insulated switchgear includes a circuit breaker CB and a switch EDS such as a disconnector and a grounding switch as shown in FIG. 8.

The switch used as the disconnector mounted in the gas-insulated switchgear is configured as shown in FIG. 1A and FIG. 1B. FIG. 1C shows a mounted state of a contact-pressure spring 3*a*.

A connection pin 6 is attached to an operation link 7 connected to a drive component of an operation device, and both ends of the connection pin 6 are inserted into pin holes 14 provided in center portions CP of two plate-shaped pieces 2*a* and 2*b* that form a blade 2 and extend in a longitudinal direction, whereby the blade 2 and the operation link 7 are connected to each other.

Stepped pin holes 13, 13 provided in the plate-shaped pieces 2*a* and 2*b* at one end portion EP of the blade 2 and a stepped pin hole 13*a* provided in a fixed contactor 1*a* are connected by a stepped pin 4*a*. The stepped pin 4*a* pivotally attaches each of the plate-shaped pieces 2*a* and 2*b* to the fixed contactor 1*a* at one end portion EPa or EPb thereof, and the blade 2 is rotatably attached with the stepped pin 4*a* as an axis and with the one end portion EP thereof as a rotation center.

The contact-pressure spring 3*a* is mounted to one surface side of the blade 2 and a stepped pin step portion 15 of the stepped pin 4*a* as shown in FIG. 1C, such that a contact pressure is applied between the blade 2 and the fixed contactor 1*a*.

The fixed contactor 1*a* and the blade 2 are brought into contact with each other by the contact pressure generated by the contact-pressure spring 3*a*, and slits 8 are provided in conductive contact surface regions SPa and SPb of the plate-shaped pieces 2*a* and 2*b* which form the blade 2. The slits 8 are linear narrow gaps provided in the conductive contact surface regions SPa and SPb, with respect to the fixed contactor 1*a*, of the plate-shaped pieces 2*a* and 2*b* which form the blade 2, and divide the conductive contact surface regions SPa and SPb, with respect to the fixed contactor 1*a*, of the plate-shaped pieces 2*a* and 2*b* which form the blade 2, thereby making the blade 2 and the fixed contactor 1*a* have a multi-point contact relationship. The slits 8 are narrow gaps dividing the conductive contact surface regions SPa and SPb shown in FIG. 1A and FIG. 1C in a depth direction, thereby making the blade 2 and the fixed contactor 1*a* have a multi-point contact relationship.

The slits 8 are formed as narrow gaps penetrating both surfaces of the plate-shaped pieces 2*a* and 2*b* such that a depth equal to or larger than a predetermined dimension, for example, a depth equal to or larger than 1 mm is obtained for the purpose of ensuring division of the conductive contact surface regions SPa and SPb for ensuring the multi-point contact relationship. In the case where a depth equal to or larger than a predetermined dimension, for example, a depth equal to or larger than 1 mm is obtained, the slits 8 can also be formed as grooves having a bottom and a depth equal to or larger than 1 mm, instead of narrow gaps. The narrow gaps or the grooves forming the slits 8 each have a width equal to or larger than a predetermined dimension, for example, a width equal to or larger than 1 mm, in order to ensure division of the conductive contact surface regions SPa and SPb for ensuring the multi-point contact relationship. The slits 8 are provided in the respective plate-shaped pieces 2*a* and 2*b* respectively forming strip shapes forming the blade 2, and extends along the direction in which the plate-shaped pieces 2*a* and 2*b* extend. The slits 8 can divide the conductive contact surface regions SPa and SPb, with respect to the fixed contactor 1*a*, of the plate-shaped pieces 2*a* and 2*b* which form the blade 2, and also can extend beyond the conductive contact surface regions SPa and SPb to regions other than the conductive contact surface regions SPa and SPb. In addition, as described later, slits 8 are also provided in other end portions EFa and EFb of the plate-shaped pieces 2*a* and 2*b*, and the slits 8 provided in both the one end portions EPa and EPb and the other end portions EFa and EFb of the plate-shaped pieces 2*a* and 2*b* are formed in shapes symmetrical to each other.

The operation mode of the switch shown in FIG. 1A and FIG. 1B shows an open circuit state. Whereas the fixed contactor 1*a* and the blade 2 are constantly in contact with each other, a fixed contactor 1*b* and the blade 2 are in a non-contact insulating state, and an electric path between the fixed contactor 1*a* and the fixed contactor 1*b* is open.

A tubular spacer 5 is provided between the other end portions EFa and EFb of the plate-shaped pieces 2*a* and 2*b* at another end portion EF of the blade 2 so as to be fitted onto a stepped pin 4*b* such that a gap g is ensured between the plate-shaped pieces 2*a* and 2*b* in order to allow the fixed contactor 1*b* to be inserted between the plate-shaped pieces 2*a* and 2*b* at the time of closed circuit operation.

In the case where the switch is shifted to a closed circuit state, the operation link 7 moves to the right in the drawing by drive of the operation device according to an operation command. The blade 2 is rotated counterclockwise to move the other end portion EF of the blade 2 toward the fixed contactor 1*b*, whereby a state where the fixed contactor 1*b* is held between the plate-shaped pieces 2*a* and 2*b* is obtained, and the plate-shaped pieces 2*a* and 2*b* are brought into contact with the fixed contactor 1*b*, so that the closed circuit state shown in FIG. 2A and FIG. 2B is obtained. The plate-shaped pieces 2*a* and 2*b* which form the blade 2 bridge the fixed contactor 1*a* and the fixed contactor 1*b* to electrically and mechanically conduct and connect the fixed contactors 1*a* and 1*b*.

A contact-pressure spring 3*b* is mounted between the one surface side of the blade 2 and a step portion of the stepped pin 4*b*, and the spacer 5 is mounted between gaps of the blade 2. At this time, a structure is formed in which the contact-pressure springs 3*a* and 3*b* can be deformed, by making the thicknesses of the fixed contactors 1*a* and 1*b* larger than the gap g (see FIG. 1A) of the blade 2, in order to generate a contact pressure between the contactors.

A thickness dimension of the fixed contactor 1*b* which is inserted between the other end portions EFa and EFb of the plate-shaped pieces 2*a* and 2*b* is set so as to be slightly larger than the gap g (see FIG. 1A), between the plate-shaped pieces 2*a* and 2*b*, ensured by the spacer 5, and a predetermined contact-pressure load is applied to conductive contact surface regions SFa and SFb of the plate-shaped pieces 2*a* and 2*b* by the contact-pressure spring 3*b*. FIG. 2C shows a mounted state of the contact-pressure spring 3*b*.

A contact-pressure spring fixing portion EC of the blade 2 to which the contact-pressure spring 3*b* is mounted is formed such that the thickness thereof is smaller than that of each of the other end portions EFa and EFb of the plate-shaped pieces 2*a* and 2*b* which form the blade 2 and between which the fixed contactor 1*b* is inserted. Therefore, the stiffness of the contact-pressure spring fixing portion EC is low, and the contact-pressure spring fixing portion EC is easily deformed when the fixed contactor 1*b* is inserted, so that it is easy to smoothly join the other end portion EF of the blade 2 and the fixed contactor 1*b*.

Moreover, since the thicknesses of the center portion CP and the other end portion EF of the blade 2 are larger than that of the contact-pressure spring fixing portion EC, stiffness of the blade 2 can be ensured. At the other end portion EF, the blade 2 serves to firmly join the fixed contactor 1*b*.

Furthermore, similar to the thickness of the contact-pressure spring fixing portion EC, the thickness of the one end portion EP of the blade 2 is also made smaller than the thicknesses of the center portion CP and the other end portion EF of the blade 2. Although the one end portion EP and the fixed contactor 1*a* do not come into contact with and move away from each other due to the opening/closing operation of the switch, but slide relative to each other, the one end portion EP is easily deformed by thinning the one end portion EP, and the opening/closing operation of the switch becomes smooth.

In the closed circuit state of the switch, as shown in FIGS. 2A and 2B, the blade 2 and the fixed contactor 1*b* are mechanically and electrically connected by the contact-pressure load generated by the contact-pressure spring 3*b*, and form a circuit on the power receiving side, the power feeding side, or the ground side. In addition, in the closed circuit state, a structure is formed in which the slits 8 of the blade 2 are deeper by at least 1 mm or greater than portions where the blade 2 and the fixed contactors 1*a* and 1*b* come into contact with each other. The structure is formed as a structure in which the slits 8 of the blade 2 are more reliably separated from the fixed contactors 1*a* and 1*b* than the conductive contact surfaces, and this structure divides a current (this is because a current cannot be divided if the slits 8 are in full contact with the fixed contactors 1*a* and 1*b*). The slits 8 that are the same as those in the one end portion EP of the blade 2 are also provided at the side of the other end portion EF which is a free rotation end of the blade 2. By providing the slits 8 in the conductive contact surface regions SFa and SFb where the other end portions EFa and EFb of the plate-shaped pieces 2*a* and 2*b* are in contact with the fixed contactor 1*b* in the closed circuit state of the switch, the conductive contact surface regions SFa and SFb, with respect to the fixed contactor 1*b*, of the plate-shaped pieces 2*a* and 2*b* which form the blade 2 are divided, thereby making the blade 2 and the fixed contactor 1*b* have a multi-point contact relationship.

As shown in FIGS. 3A and 3B, a chamfered portion 9 having an arcuate curved surface by so-called R processing is provided at each of edges on the peripheries the plate-shaped pieces 2*a* and 2*b* and the entire peripheries of the slits 8 provided in the one end portions EPa and EPb and the other end portions EFa and EFb of the plate-shaped pieces 2*a* and 2*b* which form the blade 2. By providing the chamfered portion 9 by R processing, the amount of mechanical wear due to sliding between the blade 2 and the conductive contact surfaces of the fixed contactors 1*a* and 1*b* can be reduced, whereby high reliability and extended life can be achieved. In addition, the stepped pin holes 13 for the stepped pins 4*a* and 4*b* and the pin hole 14 for the connection pin 6 connected to the operation link 7 are provided. As for the slits 8 provided in the one end portions EPa and EPb and the other end portions EFa and EFb of the plate-shaped pieces 2*a* and 2*b*, the slits 8 provided in the one end portions EPa and EPb and the slits 8 provided in the other end portions EFa and EFb are formed in shapes symmetrical to each other.

In Embodiment 1, as described above, the conductive contact surface regions SPa and SPb, SFa, and SFb, with respect to the fixed contactor 1*a* and the fixed contactor 1*b*, of the plate-shaped pieces 2*a* and 2*b* at both end portions EP and EF of the blade 2 are divided by the slits 8, so that the contact relationships of the plate-shaped pieces 2*a* and 2*b* with the fixed contactor 1*a* and the fixed contactor 1*b* are multi-point contact relationships at both end portions EP and EF of the blade 2.

By making the contact relationships with the fixed contactors 1*a* and 1*b* to be multi-point contact relationships at both end portions EP and EF of the blade 2, the contact-pressure load on each of the conductive contact surfaces at both end portions EP and EF of the blade 2 to be rotationally operated is reduced appropriately in a well-balanced manner, so that the reliability of the switch can be improved and the life of the switch can be extended.

FIG. 4 is a chart showing a relationship between current value per contact point of a contactor and contact-pressure load at which welding of contactors does not occur.

FIG. 4 shows that the amount of current per contact point is reduced to ½ and it is possible to reduce a contact-pressure spring load to ¼ from a threshold of a contact-pressure spring load at which welding does not occur between contactors, by providing the slits 8 at both ends of the blade 2 or providing slits 8 in fixed contactors 11*a* and 11*b* in FIGS. 5A to 5D described later.

(1) For the switch according to Embodiment 1, the following configuration is applied as shown in FIGS. 1A to 1C, FIGS. 2A to 2C, and FIGS. 3A and 3B.

The configuration includes: a first fixed contactor 1*a*; a second fixed contactor 1*b* disposed at a predetermined interval from the first fixed contactor 1*a*; and a blade 2 having one end portion EP which is pivotally attached to the first fixed contactor 1*a*, and another end portion EF which is jointed to the second fixed contactor 1*b*, by a rotation operation by an operation device having an operation link 7, to bridge the first and second fixed contactors 1*a* and 1*b* to electrically and mechanically conduct and connect the first and second fixed contactors 1*a* and 1*b*, wherein the one end portion EP of the blade 2 is brought into pressure contact with the first fixed contactor 1*a* by a contact-pressure spring 3*a*, and the other end portion EF of the blade 2 is brought into pressure contact with the second fixed contactor 1*b* by a contact-pressure spring 3*b* in a state where the other end portion EF is joined to the second fixed contactor 1*b*.

The blade 2 is formed by a pair of plate-shaped pieces 2*a* and 2*b* having strip shapes, extending in a longitudinal direction, and opposing each other, the first fixed contactor 1*a* is brought into pressure contact with and held between one end portions EPa and EPb of the pair of plate-shaped pieces 2*a* and 2*b*, the second fixed contactor 1*b* is brought into pressure contact with and held between other end portions EFa and EFb of the pair of plate-shaped pieces 2*a* and 2*b* in a state where the other end portion EF of the blade 2 is joined to the second fixed contactor 1*b*, and at least one slit 8 is provided in each of conductive contact surfaces SPa and SPb, with respect to the first fixed contactor 1*a*, of the one end portions EPa and EPb of the pair of plate-shaped pieces 2*a* and 2*b* and conductive contact surfaces SFa and SFb, with respect to the second fixed contactor 1*b*, of the other end portions EFa and EFb of the pair of plate-shaped pieces 2*a* and 2*b* so as to divide each of the conductive contact surfaces SPa, SPb, SFa, and SFb, thereby achieving multi-point contact on each of the conductive contact surfaces SPa, SPb, SFa, and SFb.

Based on this configuration, since multi-point contact is achieved on each of the conductive contact surfaces SPa, SPb, SFa, and SFb at the one end portion EP and the other end portion EF of the blade 2 by the slit 8, a contact-pressure load on each conductive contact surface at both the one end portion EP and the other end portion EF of the blade 2 to be rotationally operated can be reduced appropriately in a well-balanced manner, so that the reliability of the switch can be improved and the life of the switch can be extended.

In other words, since the slits 8 are provided at both ends of the blade 2 and the blade 2 is brought into multi-point contact with the fixed contactors 1*a* and 1*b*, a large current at the time of a closed circuit can be divided, and a current flowing per contact point can be reduced. Therefore, a contact-pressure spring load for preventing arcing between the contactors and welding of the metal contactors due to opening of a contact part caused by electromagnetic force generated when a large current is generated can be reduced, manual assembly becomes possible, and the number of steps can be reduced, even though a circuit is conventionally assembled with a special assembly jig due to a contact-pressure spring load being high.

Moreover, in order to generate a contact pressure between each contactor in opening/closing of the circuit, it is necessary to make the thickness of the fixed contactor 1*b* larger than the gap g between the pair of plate-shaped pieces 2*a* and 2*b* forming the blade 2. In shifting to a closed circuit, first, the blade 2 and the tip end of the fixed contactor 1*b* come into contact with each other; then, the blade 2 slides on the conductive contact surface of the fixed contactor 1*b* while expanding the gap g between the plate-shaped pieces 2*a* and 2*b* of the blade. Thus, the influence of mechanical wear of the conductive contact surface is great, and there is a concern about an increase in contact resistance and sliding load of the conductive contact surface. However, since the contact-pressure spring load can be reduced, the amount of mechanical wear of the sliding surface of each contactor due to repeated opening/closing operation can be reduced, so that high reliability and extended life can be achieved.

Furthermore, in the switch according to Embodiment 1, the contact-pressure spring fixing portion EC of the blade 2 is formed so as to be thinner than the center portions CP of the plate-shaped pieces 2*a* and 2*b* and the other end portion EF of the blade 2, and the contact-pressure spring 3*b* is mounted on the contact-pressure spring fixing portion EC.

Due to this configuration, that is, since the slit 8 is provided in the contact-pressure spring fixing portion EC and formed so as to be thinner than the center portions CP of the plate-shaped pieces 2*a* and 2*b* and the other end portion EF, joining to the second fixed contactor 1*b* is easily performed, and the opening/closing operation of the switch becomes smooth, so that the reliability of the switch can be improved and the life of the switch can be extended.

(2) For the switch according to Embodiment 1, the following configuration is applied in the configuration of the above (1), as shown in FIGS. 1A to 1C, FIGS. 2A to 2C, and FIGS. 3A and 3B.

Similar to the thickness of the contact-pressure spring fixing portion EC, the thickness of the one end portion EP on which the contact-pressure spring 3*a* is mounted is made thinner than other portions, that is, the center portion CP and the other end portion EF of the blade 2, whereby the one end portion EP is easily deformed by the spring force of the contact-pressure spring 3*a*.

Due to this configuration, although the one end portion EP and the first fixed contactor 1*a* do not come into contact with and move away from each other due to the opening/closing operation of the switch, but slide relative to each other, the one end portion EP is easily deformed by thinning the one end portion EP, and the opening/closing operation of the switch becomes smooth, so that the reliability of the switch can be improved and the life of the switch can be extended.

(3) For the switch according to Embodiment 1, the following configuration is applied in the configuration of the above (1) or (2), as shown in FIGS. 1A to 1C, FIGS. 2A to 2C, and FIGS. 3A and 3B.

The slits 8 extend in a longitudinal direction of the pair of plate-shaped pieces 2*a* and 2*b* of the blade 2.

Due to this configuration, the slits 8 for establishing a multi-point contact relationship can be appropriately located in accordance with the shape of the blade 2, and an appropriate configuration can be ensured.

(4) For the switch according to Embodiment 1, the following configuration is applied in the configuration of any one of the above (1) to (3), as shown in FIGS. 1A to 1C, FIGS. 2A to 2C, and FIGS. 3A and 3B.

The slits 8 provided in the one end portions EPa and EPb and the other end portions EFa and EFb of the pair of plate-shaped pieces 2*a* and 2*b* are formed in shapes symmetrical to each other.

Due to this configuration, the contact-pressure load on each conductive contact surface at both the one end portion EP and the other end portion EF of the blade 2 to be rotationally operated is reduced further appropriately in a further well-balanced manner, so that the reliability of the switch can be improved and the life of the switch can be extended.

(5) For the switch according to Embodiment 1, the following configuration is applied in the configuration of any one of the above (1) to (4), as shown in FIGS. 1A to 1C, FIGS. 2A to 2C, and FIGS. 3A and 3B.

The chamfered portion 9 having an arcuate curved surface by so-called R processing is provided at each of edges of the conductive contact surfaces SPa, SPb, SFa, and SFb in which the slits 8 are provided.

Due to this configuration, the amount of mechanical wear due to sliding between the blade 2 and each of the conductive contact surfaces of the fixed contactors 1*a* and 1*b* which are brought into multi-point contact with each other can be reduced, so that high reliability and extended life can be achieved.

Embodiment 2

Figure 5A:
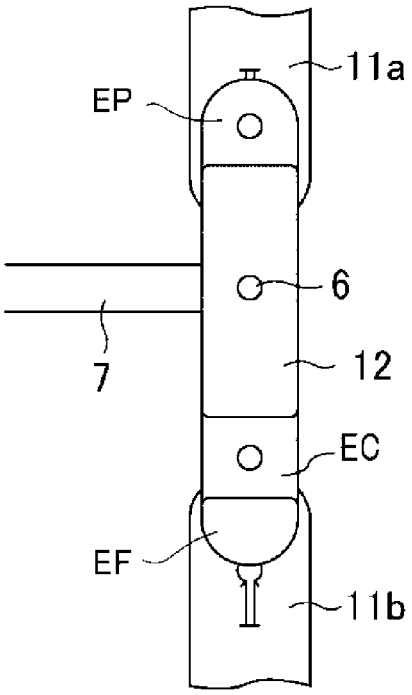
FIGS. 5A to 5D are structural diagrams showing the configuration of a switch according to Embodiment 2.
Figure 5B:
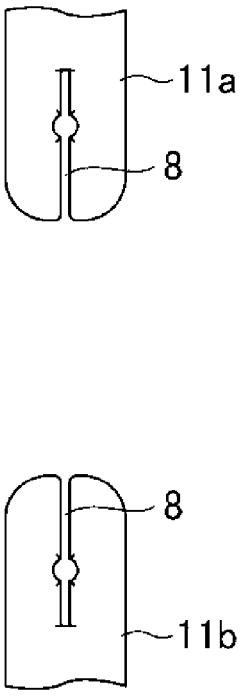

Embodiment 2 will be described with reference to FIGS. 5A to 5D. FIG. 5A is a structural diagram showing the configuration of a switch according to Embodiment 2 in a closed circuit state, and FIG. 5B is a plan view showing the configuration of a fixed contactor.

Figure 5C:
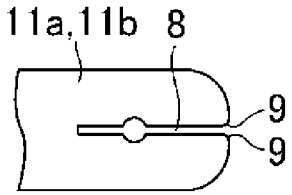
Figure 5D:
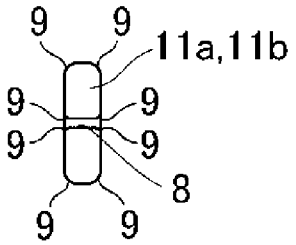

The basic configuration of the switch according to Embodiment 2 is the same as the configuration in Embodiment 1. The difference of the configuration shown in Embodiment 2 from Embodiment 1 is that slits 8 are provided in the fixed contactors 11*a* and 11*b*, and the fixed contactors 11*a* and 11*b* are brought into multi-point contact with a blade 12. As shown in FIG. 5C which is a plan view of the fixed contactor 11*b* and FIG. 5D which is an end view of the fixed contactor 11*b*, a chamfered portion 9 formed by so-called R processing is provided at each of the entire peripheries of the slits 8 of the fixed contactors 11*a* and 11*b* and edges on the contactor peripheries, and, similar to FIGS. 1A to 1C, a structure is formed in which the contact-pressure springs can be deformed, by making the thicknesses of the fixed contactors 11*a* and 11*b* larger than the gap g (see FIG. 1A) of the blade 12, in order to generate a contact pressure between the contactors.

Moreover, in the closed circuit state, a structure is formed in which the slits 8 provided in the fixed contactors 11*a* and 11*b* are deeper by at least 1 mm or greater than portions where the blade 12 and the fixed contactors 11*a* and 11*b* come into contact with each other.

Also, in the case where the slits 8 are provided in the fixed contactors 11*a* and 11*b*, as in Embodiment 1, the thickness of the contact-pressure spring fixing portion EC of the blade 12 is made smaller than those of the center portion CP and the other end portion EF with which the fixed contactor 11*b* come into contact. Thus, in the case where the switch is shifted to the closed circuit state, the other end portion EF and the second fixed contactor 11*b* can be easily joined by deformation of the contact-pressure spring fixing portion EC.

Moreover, similar to the thickness of the contact-pressure spring fixing portion EC, the thickness of the one end portion EP of the blade 12 is made smaller than the thicknesses of the center portion CP and the other end portion EF of the blade 12. Thus, in sliding due to the opening/closing operation of the switch, the one end portion EP is easily deformed, and the opening/closing operation of the switch becomes smooth.

Furthermore, since, similar to the thickness of the contact-pressure spring fixing portion EC, the thickness of the one end portion EP on which the contact-pressure spring is mounted is made smaller than those of other portions, the one end portion EP is easily deformed by the spring force of the contact-pressure spring.

Due to this configuration, although the one end portion EP and the first fixed contactor 11*a* do not come into contact with and move away from each other due to the opening/closing operation of the switch, but slide relative to each other, the one end portion EP is easily deformed by thinning the one end portion EP, and the opening/closing operation of the switch becomes smooth, so that the reliability of the switch can be improved and the life of the switch can be extended.

The slits 8, 8 provided in the fixed contactors 11*a* and 11*b* extend in the direction in which the blade 12 in the closed circuit state extends and are formed in shapes symmetrical to each other. In addition, the fixed contactors 11*a* and 11*b* in which the slits 8 are provided are formed in shapes symmetrical to each other.

(1) For the switch according to Embodiment 2, the following configuration is applied as shown in FIGS. 5A to 5D.

The configuration includes: a first fixed contactor 11*a*; a second fixed contactor 11*b* disposed at a predetermined interval from the first fixed contactor 11*a*; and a blade 12 having one end portion EP which is pivotally attached to the first fixed contactor 11*a*, and another end portion EF which is jointed to the second fixed contactor 11*b*, by a rotation operation by an operation device having an operation link 7, to bridge the first and second fixed contactors 11*a* and 11*b* to electrically and mechanically conduct and connect the first and second fixed contactors 11*a* and 11*b*, wherein the one end portion EP of the blade 12 is brought into pressure contact with the first fixed contactor 11*a* by a contact-pressure spring, and the other end portion EF of the blade 12 is brought into pressure contact with the second fixed contactor 11*b* by a contact-pressure spring in a state where the other end portion EF is joined to the second fixed contactor 11*b*.

The blade 12 is formed by a pair of plate-shaped pieces having strip shapes, extending in a longitudinal direction, and opposing each other, the first fixed contactor 11*a* is brought into pressure contact with and held between one end portions of the pair of plate-shaped pieces, the second fixed contactor 11*b* is brought into pressure contact with and held between other end portions of the pair of plate-shaped pieces in a state where the other end portion EF of the blade 12 is joined to the second fixed contactor 11*b*, and at least one slit 8 is provided in each of conductive contact surfaces, with respect to the one end portions of the pair of plate-shaped pieces, of the first fixed contactor 11*a* and conductive contact surfaces, with respect to the other end portions of the pair of plate-shaped pieces, of the second fixed contactor 11*b* so as to divide each of the conductive contact surfaces, thereby achieving multi-point contact on each of the conductive contact surfaces.

Due to this configuration, since multi-point contact is achieved on each of the conductive contact surfaces, with respect to the one end portion EP and the other end portion EF of the blade 12, of the fixed contactors 11*a* and 11*b* by the slit 8, a contact-pressure load on each conductive contact surface at both the one end portion EP and the other end portion EF of the blade 12 to be rotationally operated can be reduced appropriately in a well-balanced manner, so that the reliability of the switch can be improved and the life of the switch can be extended.

Moreover, in the switch according to Embodiment 2, the one end portion EP and the contact-pressure spring fixing portion EC of the blade 12 are formed so as to be thinner than the center portion CP of the blade 12, and the contact-pressure springs 3*a* and 3*b* are mounted on the one end portion EP and the contact-pressure spring fixing portion EC, respectively.

Due to this configuration, that is, since the contact-pressure spring fixing portion EC, where the slit 8 is provided, formed so as to be thinner than the center portions CP and the other end portion EF of the blade 12, joining to the second fixed contactor 11*b* is easily performed, and the opening/closing operation of the switch becomes smooth, so that the reliability of the switch can be improved and the life of the switch can be extended. Furthermore, since the one end portion EP of the blade 12 is formed so as to be thinner than the center portion CP and the other end portion EF of the blade 12, the same advantageous effects as those in Embodiment 1 are achieved.

(2) For the switch according to Embodiment 2, the following configuration is applied in the configuration of the above (1), as shown in FIGS. 5A to 5D.

The slits 8 extend in a longitudinal direction of the pair of plate-shaped pieces in a state where the other end portion EF of the blade 12 is joined to the second fixed contactor 11*b*.

Due to this configuration, the slits 8 for establishing a multi-point contact relationship can be appropriately located in accordance with the shape of the blade 12, and an appropriate configuration can be ensured.

(3) For the switch according to Embodiment 2, the following configuration is applied in the configuration of the above (1) or (2), as shown in FIGS. 5A to 5D.

The first and second fixed contactors 11*a* and 11*b* in which the slits 8 are provided are formed in shapes symmetrical to each other.

Due to this configuration, the contact-pressure load on each conductive contact surface at both the one end portion EP and the other end portion EF of the blade 12 to be rotationally operated is reduced further appropriately in a further well-balanced manner, so that the reliability of the switch can be improved and the life of the switch can be extended.

(4) For the switch according to Embodiment 2, the following configuration is applied in the configuration of any one of the above (1) to (3).

A chamfered portion having an arcuate curved surface by so-called R processing is provided at each of edges of the conductive contact surfaces in which the slits 8 are provided.

Due to this configuration, the amount of mechanical wear due to sliding between the blade 12 and each of the conductive contact surfaces of the fixed contactors 11*a* and 11*b* which are brought into multi-point contact with each other can be reduced, so that high reliability and extended life can be achieved.

Embodiment 3

Figure 6A:
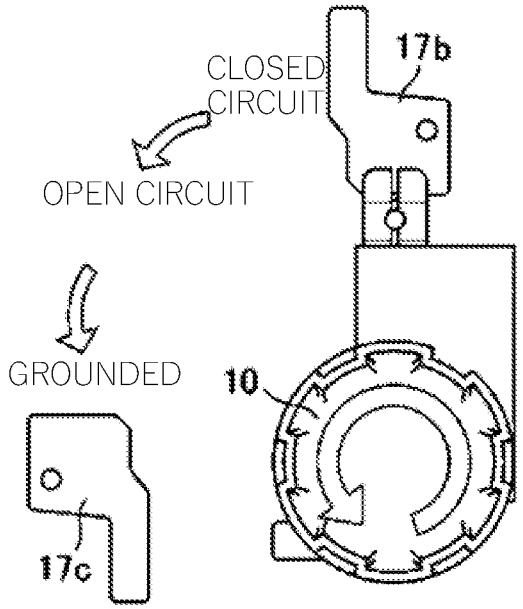
FIGS. 6A and 6B are structural diagrams showing the configuration of a switch according to Embodiment 3.
Figure 6B:
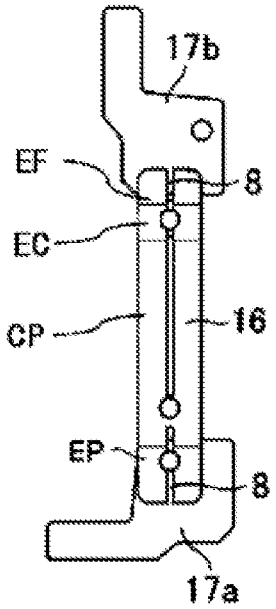
Figure 7A:
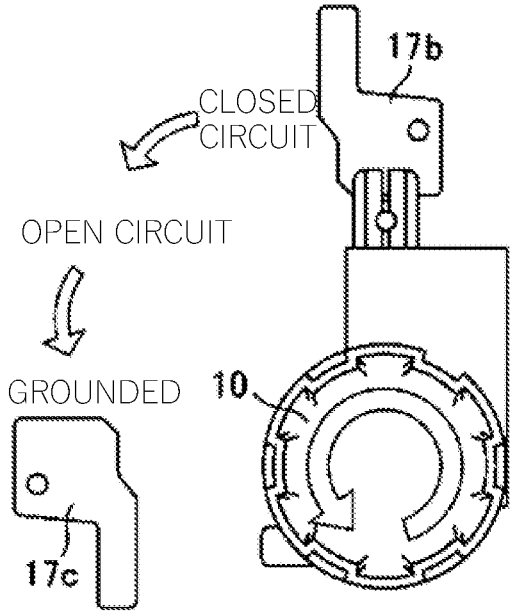
FIGS. 7A and 7B are structural diagrams showing the configuration of another switch according to Embodiment 3.
Figure 7B:
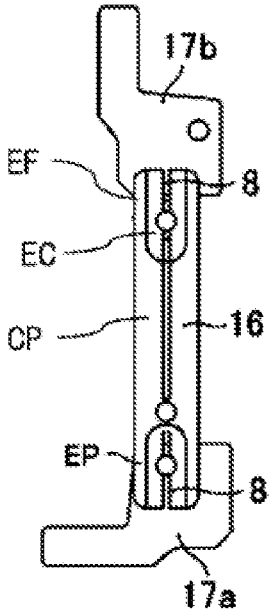

Embodiment 3 will be described with reference to FIGS. 6A and 6B and FIGS. 7A and 7B. FIGS. 6A and 6B are structural diagrams showing the configuration of a switch according to Embodiment 3, FIG. 6A is a front view of the switch, and FIG. 6B is a structural diagram showing an internal configuration in which a connection adapter 10 is removed. FIGS. 7A and 7B are structural diagrams showing the configuration of another switch according to Embodiment 3, FIG. 7A is a front view of the switch, and FIG. 7B is a structural diagram showing an internal configuration in which a connection adapter 10 is removed.

The difference between the configuration of the switch in FIGS. 6A and 6B according to Embodiment 3 and the configuration of the switch shown in FIGS. 1A to 1C and FIGS. 2A to 2C according to Embodiment 1 is as follows. In FIG. 1B and FIG. 2B, the operation link 7 connected to the connection pin 6 mounted on the center hole of the blade 2 is connected to the operation device, and the blade 2 of the switch moves in an arcuate shape by linear motion of a drive portion of the operation device, thereby opening/closing the circuit. Meanwhile, in Embodiment 3, a blade 16 is mounted on the connection adapter 10 directly connected to an operation mechanism, and it is possible to drive the blade 16 in an arcuate shape by rotation of a drive portion of the operation mechanism about an axis. One end portion EP of the blade 16 is pivotally attached to a fixed contactor 17*a*, and another end portion EF of the blade 16 which is a free end is rotationally operated by the connection adapter 10 directly connected to the operation mechanism.

Similar to Embodiment 1, the blade 16 in FIGS. 6A and 6B is composed of a pair of plate-shaped pieces, and a contact-pressure spring is provided on a contact-pressure spring fixing portion EC of the blade 16 in order to bring the other end portion EF and fixed contactors 17*b* and 17*c* into pressure contact with each other. In addition, the thicknesses of the contact-pressure spring fixing portion EC and the one end portion EP are made smaller than those of the other end portion EF and the center portion CP of the blade 16, and the stiffness of the contact-pressure spring fixing portion EC and the one end portion EP is decreased. Thus, the contact-pressure spring fixing portion EC and the one end portion EP are easily deformed, so that opening/closing operation and rotation operation can be performed smoothly.

In a closed circuit state shown in FIG. 6A, the one end portion EP of the blade 16 is connected to the fixed contactor 17*a* by application of a contact pressure, and the blade 16 is rotationally operated counterclockwise by giving an open circuit command to an operation device, whereby the other end portion EF of the blade 16 comes into contact with and becomes connected to the fixed contactor 17*c* for grounding, thereby obtaining a grounded state.

Moreover, although both ends of the blades 2 and 12 shown in Embodiments 1 and 2 have an arcuate shape or a semicircular shape, the blade 16 of Embodiment 3 has an angular shape with chamfered corners. Similar to Embodiment 1, chamfered portions 9 formed by so-called R processing are provided at the slits 8 and around the slits 8. However, both end portions EP and EF of the blade 16 and the fixed contactors 17*a*, 17*b*, and 17*c* are formed in an angular shape, whereby the areas of the conductive contact surfaces are increased, and the amount of mechanical wear due to sliding of the conductive contact surfaces can be reduced.

The connection adapter 10 is directly connected to the operation mechanism, and serves to reduce the number of rotations of a rotary drive shaft provided to the drive portion of the operation mechanism and mechanically convert the rotation of the rotary drive shaft into a rotational motion with a predetermined operating angle. The connection adapter 10 has a rotation input portion connected to the rotary drive shaft of the operation mechanism, and an output portion connected to the blade 16.

In the other switch shown in FIGS. 7A and 7B, a region, of the contact-pressure spring fixing portion EC of the blade 16, from a portion where a contact-pressure spring is provided, to an end portion along a slit, and a region, of the one end portion EP of the blade 16, from a portion where a contact-pressure spring is provided, to an end portion along a slit, are formed so as to be thinner than the center portion CP of the blade 16. In this case as well, opening/closing operation and rotation operation can be performed smoothly. In addition, the thickness of a side portion in the longitudinal direction of the other end portion EF is not thin, and thus joining to and pressure contact with the fixed contactors 17*b* and 17*c* can also be firmly maintained.

FIGS. 6B and 7B each show an example in which the slits are formed in the blade 16, but slits may be provided in the fixed contactors 17*a*, 17*b*, and 17*c* as in Embodiment 2.

Furthermore, in Embodiment 3, a link mechanism is not provided to the center portion CP of the blade 16, and thus, instead, the pair of plate-shaped pieces may be joined at the center portion by welding or the like with a spacer interposed therebetween, thereby enhancing the strength of the blade 16. In addition, the blade 16 does not have to be composed of a pair of plate-shaped pieces as described above, one angular member may be used, opposing surfaces thereof from both ends through contact-pressure spring formation portions to the vicinity of a center portion may be scraped such that a predetermined thickness is left, to form a pair of surfaces having cross-sections that are open in a U shape from the center portion toward both ends, both end portions EP and EF and the contact-pressure spring fixing portion EC may be formed by using the pair of surfaces, and the contact-pressure springs may be provided thereon.

For the switch according to Embodiment 3, the following configuration is applied in the configuration in Embodiment 1 or Embodiment 2 described above, as shown in FIGS. 6A and 6B and FIGS. 7A and 7B.

The operation device operates the blade 16 by rotation of the rotary drive shaft, the connection adapter 10 is directly connected to the rotary drive shaft, and the blade 16 is rotationally operated through the connection adapter 10 in accordance with rotation of the rotary drive shaft.

Due to this configuration, a switch that can accurately operate the blade 16 by the connection adapter 10 directly connected to the operation mechanism and has high reliability can be obtained.

In Embodiment 1 to Embodiment 3 described above, one slit is provided in one contactor, but the number of slits is not limited thereto. Two or more slits may be provided in one contactor. In this case, contact points of multi-point contact between the contactors can be increased.

Although the present disclosure is described above in terms of various exemplary embodiments and examples, it should be understood that the various features, aspects and functionality described in one or more of the individual embodiments are not limited in their applicability to the particular embodiment with which they are described, but instead can be applied, alone or in various combinations to one or more of the embodiments of the disclosure.

It is therefore understood that numerous modifications which have not been exemplified can be devised without departing from the scope of the present disclosure. For example, at least one of the constituent components may be modified, added, or eliminated. At least one of the constituent components mentioned in at least one of the preferred embodiments may be selected and combined with the constituent components mentioned in another preferred embodiment.

DESCRIPTION OF THE REFERENCE CHARACTERS

1*a* fixed contactor
1*b* fixed contactor
2 blade
2*a* plate-shaped piece
2*b* plate-shaped piece
3*a* contact-pressure spring
3*b* contact-pressure spring
4*a* stepped pin
4*b* stepped pin
5 spacer
6 connection pin
7 operation link
8 slit
9 chamfered portion
10 connection adapter
11*a* fixed contactor
11*b* fixed contactor
12 blade
13 stepped pin hole
13*a* stepped pin hole
14 pin hole
15 stepped pin step portion
16 blade
17*a* fixed contactor
17*b* fixed contactor
17*c* fixed contactor
CP center portion of blade
EC contact-pressure spring fixing portion
EP, EF end portion of blade

The invention claimed is:

1. A switch comprising:

a first fixed contactor;

a second fixed contactor disposed at a predetermined interval from the first fixed contactor; and a blade having one end portion which is pivotally attached to the first fixed contactor, and another end portion which is joined to the second fixed contactor by rotational operation by an operation device to bridge and electrically connect the first and second fixed contactors, wherein the one end portion of the blade is brought into pressure contact with the first fixed contactor, the other end portion of the blade is brought into pressure contact with the second fixed contactor by a first contact-pressure spring in a state where the other end portion is joined to the second fixed contactor, at least one slit is provided in each of a conductive contact surface, with respect to the first fixed contactor, of the one end portion of the blade and a conductive contact surface, with respect to the second fixed contactor, of the other end portion of the blade, or in each of a conductive contact surface, with respect to the one end portion of the blade, of the first fixed contactor and a conductive contact surface, with respect to the other end portion of the blade, of the second fixed contactor, so as to divide each of the conductive contact surfaces, a thickness of a contact-pressure spring fixing portion of the blade at which the first contact-pressure spring is provided is smaller than that of the other end portion of the blade which is joined to the second fixed contactor, a second contact-pressure spring is provided at the one end portion of the blade, and a thickness of the one end portion of the blade is smaller than that of the other end portion of the blade.

2. The switch according to claim 1, wherein the blade is formed by a pair of plate-shaped pieces extending in a longitudinal direction and opposing each other, the first fixed contactor is brought into pressure contact with and held between one end portions of the pair of plate-shaped pieces, and the second fixed contactor is brought into pressure contact with and held between other end portions of the pair of plate-shaped pieces in a state where the other end portion of the blade is joined to the second fixed contactor.

3. The switch according to claim 2, wherein the slits extend in a longitudinal direction of the pair of plate-shaped pieces.

4. The switch according to claim 3, wherein the slits provided in the one end portions and the other end portions of the pair of plate-shaped pieces are formed in shapes symmetrical to each other.

5. The switch according to claim 2, or wherein the slits provided in the one end portions and the other end portions of the pair of plate-shaped pieces are formed in shapes symmetrical to each other.

6. The switch according to claim 2, wherein the slits are provided in the first fixed contactor and the second fixed contactor.

7. The switch according to claim 1, wherein the slits are provided in the first fixed contactor and the second fixed contactor.

8. The switch according to claim 7, wherein the slits extend in a longitudinal direction of the blade in a state where the other end portion of the blade is joined to the second fixed contactor.

9. The switch according to claim 8, wherein the slits provided in the first and second fixed contactors are formed in shapes symmetrical to each other.

10. The switch according to claim 7, wherein the slits provided in the first and second fixed contactors are formed in shapes symmetrical to each other.

11. The switch according to claim 1, wherein a chamfered portion is provided at each of edges of the conductive contact surfaces in which the slits are provided.

12. The switch according to claim 1, wherein the operation device operates the blade by rotation of a rotary drive shaft, a connection adapter is directly connected to the rotary drive shaft, and the blade is rotationally operated through the connection adapter in accordance with rotation of the rotary drive shaft.

* * * * *